US009028114B2

(12) United States Patent
Smith

(10) Patent No.: US 9,028,114 B2
(45) Date of Patent: May 12, 2015

(54) LIGHTING FIXTURE ASSEMBLY

(75) Inventor: Ryan Grey Smith, Seattle, WA (US)

(73) Assignee: 3form, LLC, Salt Lake City, UT (US)

( * ) Notice: Subject to any disclaimer, the term of this patent is extended or adjusted under 35 U.S.C. 154(b) by 0 days.

(21) Appl. No.: 14/130,929

(22) PCT Filed: Jul. 6, 2012

(86) PCT No.: PCT/US2012/045754

§ 371 (c)(1),
(2), (4) Date: Jan. 5, 2014

(87) PCT Pub. No.: WO2013/006790

PCT Pub. Date: Jan. 10, 2013

(65) Prior Publication Data

US 2014/0153257 A1 Jun. 5, 2014

Related U.S. Application Data

(60) Provisional application No. 61/505,473, filed on Jul. 7, 2011.

(51) Int. Cl.
*F21V 1/14* (2006.01)
*F21V 21/00* (2006.01)

(52) U.S. Cl.
CPC .. *F21V 21/00* (2013.01); *F21V 1/14* (2013.01)

(58) Field of Classification Search
CPC ..... F21V 1/146; F21V 1/12; F21V 17/12; F21V 21/03; F21V 21/104
USPC ..... 362/355, 356, 357, 360, 358, 352, 450, 362/361, 363, 367, 147, 148, 351; 40/571, 40/572, 574
See application file for complete search history.

(56) References Cited

U.S. PATENT DOCUMENTS

| | | | | | |
|---|---|---|---|---|---|
| 1,398,305 | A | * | 11/1921 | Scherer | 362/358 |
| 4,079,245 | A | * | 3/1978 | Baker | 362/355 |
| 5,613,770 | A | * | 3/1997 | Chin et al. | 362/367 |
| D561,928 | S | * | 2/2008 | Silver | D26/88 |
| D583,090 | S | * | 12/2008 | Silver | D26/85 |
| D686,363 | S | * | 7/2013 | Smith | D26/118 |

(Continued)

FOREIGN PATENT DOCUMENTS

| | | | | |
|---|---|---|---|---|
| DE | 202014002728 U1 | * | 7/2014 | F21V 1/12 |
| KR | 200350541 | | 5/2004 | |
| WO | WO2010056791 | | 5/2010 | |

OTHER PUBLICATIONS

International Preliminary Report on Patentability for PCT/US2012/045754 mailed Jan. 16, 2014.

*Primary Examiner* — Jong-Suk (James) Lee
*Assistant Examiner* — Leah S Macchiarolo
(74) *Attorney, Agent, or Firm* — Workman Nydegger

(57) ABSTRACT

Implementations of the present invention comprise lighting fixture assemblies that minimize the visibility of hardware and shadows. In particular, the lighting fixture assemblies may include no supporting hardware extending through an internal space defined, in whole or in part, by the lighting fixture assembly. In addition, the lighting fixture assemblies may include a gap between a bottom/top panel and a side panel of the lighting fixture assembly. Accordingly, lighting fixture assemblies of one or more implementations of the present invention can reduce or eliminate the visibility of internal supporting hardware and shadows on the exterior surfaces of the lighting fixture assemblies.

28 Claims, 9 Drawing Sheets

(56) References Cited

U.S. PATENT DOCUMENTS

2005/0146882 A1* 7/2005 Liao et al. ..... 362/352
2008/0232116 A1 9/2008 Kim
2012/0206925 A1* 8/2012 Shenk et al. ..... 362/352
2014/0036512 A1* 2/2014 Chabert et al. ..... 362/352

* cited by examiner

LIGHTING FIXTURE ASSEMBLY

CROSS-REFERENCE TO RELATED APPLICATIONS

This application is a 35 U.S.C. §371 U.S. National Stage of PCT Application No. PCT/US2012/045754 entitled "Lighting Fixture Assembly," filed Jul. 6, 2012, which claims priority to and the benefit of U.S. Provisional Patent Application No. 61/505,473, filed on Jul. 7, 2011, entitled "Drum Lighting Fixture Assembly." The entire content of each of the aforementioned patent applications is incorporated herein by reference.

BACKGROUND OF THE INVENTION

1. The Field of the Invention

This invention relates generally to lighting fixture assemblies that define, in whole or in part, an internal space that is configured to house light bulbs and/or other electrical circuitry.

2. Background and Relevant Art

Some conventional lighting fixtures, such as drum lighting fixtures, include outer panels that define an internal space that houses light bulbs and/or other electrical circuitry. These lighting fixtures may combine both lighting with aesthetic functions. Recent trends in building design involve the use of decorative resin materials for the outer shades of some lighting fixtures. Lighting fixtures that include outer shades, which are made in whole or in part of a resin material, are particularly popular where certain structural, optical, and aesthetic characteristics are desired. These products also tend to be less expensive, in most applications, than products that use materials such as glass and the like.

Resin materials also tend to be more flexible in terms of manufacture and assembly because they can be relatively easily bent, molded, colored, shaped, cut, and otherwise modified in a variety of different ways. Decorative resins can also provide more flexibility in color, degree of texture, gauge, and impact resistance when compared with glass and other conventional materials. Additionally, decorative resins have a fairly wide utility since they may be formed to include a large variety of colors, images, interlayers, and shapes.

Unfortunately, some conventional lighting fixtures suffer from a number of drawbacks. For example, supporting hardware in some conventional lighting fixtures is often too noticeable, unsightly, and/or does not provide an appropriate aesthetic for desired design environments. The unpleasant aesthetic of conventional mounting hardware is often magnified when used with translucent, transparent, or other outer panels that magnify texture, light, color, and form. For instance, the supporting hardware of some conventional lighting fixtures may be visible within or through the exterior surfaces of the conventional lighting fixtures. Such visible hardware can compromise the desired aesthetic effects of the lighting fixture.

Because the exterior panels of some conventional lighting fixtures include translucent materials, supporting hardware that is within the lighting fixture may cast shadows that are visible through the outer panels. These shadows may detract from the aesthetic qualities of the lighting fixture. This internal supporting hardware may show through gaps between adjacent exterior panels. Alternatively, this hardware may attach to, and extend through, a bottom panel of a light fixture, creating an undesirable look.

Similarly, joints between two or more external panels in conventional lighting fixtures may create shadows. These shadows may be especially noticeable between panels that are adjoined at different angles. For example, seams between a bottom panel and a side panel in a conventional lighting fixture shadows may create undesirable shadows. These shadows may further detract from the aesthetic qualities of the lighting fixture.

Consequently, improvements can be made over conventional lighting fixture assemblies.

BRIEF SUMMARY OF THE INVENTION

Implementations of the present invention solve one or more of the foregoing or other problems in the art with lighting fixture assemblies that reduce or otherwise minimize the visibility of supporting hardware. In particular, lighting fixture assemblies of the present invention may include one or more external panels that define, in whole or in part, an internal space where light bulbs and/or other electrical components are housed. The internal space of such lighting fixture assemblies may lack hardware extending therethrough. Accordingly, one or more implementations can improve the aesthetic qualities of the lighting fixture assemblies by eliminating the visibility of internal supporting hardware and reducing or eliminating shadows cast by supporting hardware.

For example, one implementation of a lighting fixture assembly includes a top panel having an outer edge, a bottom panel having an outer edge, and one or more side panels. The one or more side panels are secured to the outer edge of the top panel. The outer edge of the bottom panel is secured to the one or more side panels such that the bottom panel is supported by the one or more side panels. The lighting fixture assembly further includes a mounting mechanism configured to secure the lighting fixture assembly to a support surface. The bottom panel is indirectly secured to the mounting mechanism via the one or more side panels. Furthermore, no hardware extends from the top panel to the bottom panel.

Another implementation of a lighting fixture assembly includes one or more side panels and a bottom panel having an outer edge comprising a plurality of protrusions. A plurality of fastening mechanisms secure the plurality of protrusions of the bottom panel to the one or more side panels. The plurality of protrusions create a gap between portions of the outer edge of the bottom panel and the one or more side panels. The gap reduces shadows between the one or more side panels and the bottom panel.

In addition to the foregoing, yet another implementation of a lighting fixture assembly includes a translucent top panel having an outer edge and at least one opening to provide access to an interior of the lighting fixture assembly. The lighting fixture assembly also includes a translucent bottom panel having an outer edge comprising a plurality of protrusions. Additionally, the lighting fixture assembly includes one or more translucent side panels having an upper portion and a lower portion. The outer edge of the top panel is secured to the upper portion of the one or more side panels. The plurality of protrusions along the outer edge of the bottom panel are secured to the lower portion of the one or more side panels thereby creating a gap between portions of the outer edge of the bottom panel and the one or more side panels. The lighting fixture assembly further includes a mounting mechanism directly secured to the top panel. The one or more side panels and the bottom panel are indirectly supported by the mounting mechanism via the top panel.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that mechanisms of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention comprise lighting fixture assemblies that reduce or otherwise minimize the visibility of supporting hardware. In particular, lighting fixture assemblies of the present invention may include one or more external panels that define, in whole or in part, an internal space where light bulbs and/or other electrical components are housed. The internal space of such lighting fixture assemblies may lack hardware extending therethrough. Accordingly, one or more implementations can improve the aesthetic qualities of the lighting fixture assemblies by eliminating the visibility of internal supporting hardware and reducing or eliminating shadows cast by supporting hardware.

In addition to reducing shadows created by internal hardware, implementations of the present invention may further reduce shadows at the joints of external panels (i.e., side shade panels, top panel, or bottom panel). Specifically, lighting fixture assemblies of the present invention may include a gap that separates, in whole or in part, edges of adjacent panels. This separation between adjacent panels may reduce shadows created by abutting panels.

Lighting fixture assemblies of the present invention may include one or more side panels, a top panel, and a bottom panel. A mounting mechanism can secure the lighting fixture assembly to an overhead structure by attaching to the top panel. The one or more side panels can attach directly to, and be supported by, the top panel. The bottom panel can in turn attach to, and be support by, the one or more side panels. In particular, the side panel(s) can attach to an outer edge of the bottom panel. In such implementations, the mounting mechanism may indirectly support the bottom panel via the one or more side panels. Thus, no supporting hardware may extend between the top panel and the bottom panel, or otherwise cover or obscure the bottom surface of the bottom panel.

In addition, as explained in more detail hereafter, a top and/or bottom panel may include protrusions along their outer edges to which the one or more side panels attach. The protrusions can thus create a gap between portions of the outer edge of the top and bottom panels and the one or more side panels. In this manner, shadows between the one or more side panels and the top and/or bottom panels are minimized or eliminated, thus further improving the aesthetic appeal of the lighting fixture assembly.

Figure 1:
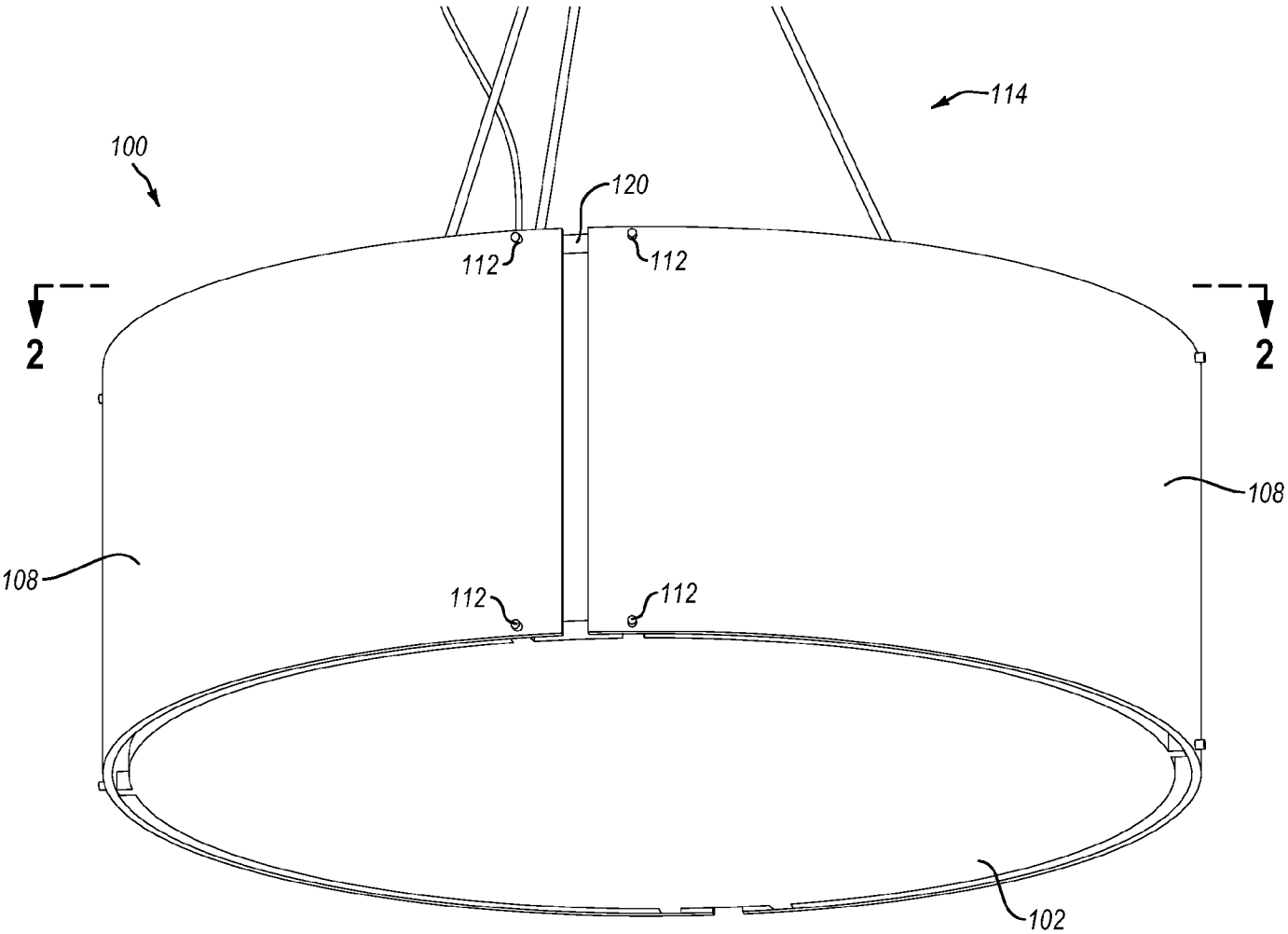
FIG. 1 illustrates a bottom perspective view of a lighting fixture assembly in accordance with one or more implementations of the present invention.

Referring now to the Figures, FIGS. 1-6 illustrate different views of lighting fixture assembly 100, or portions thereof, according to one implementation of the present invention. FIG. 1 illustrates a bottom perspective view of lighting fixture assembly 100. As shown by FIG. 1, the lighting fixture assembly 100 comprises a bottom panel 102, side panels 108, and a top panel 120.

In the implementation illustrated in FIG. 1, the bottom panel 102 is circular in shape and may be made of a translucent or transparent material. FIG. 1 further illustrates that the lighting fixture assembly 100 includes two curved side panels 108. The two curved side panels 108 can wrap around the edges of the bottom panel 102 and the top panel 120.

In any event, a mounting mechanism 114 can secure the lighting fixture assembly to an overhead support such as a junction box or a ceiling. In particular, the mounting mechanism 114 can attach to the top panel 120 and support the top panel 120 from above, as explained in greater detail below. The side panels 108 in turn can attach to, and be supported by, the top panel 120. Along similar lines, the bottom panel 120 can attach to, and be supported by, the side panels 108. In particular, fastening assemblies 112 can couple the side panel(s) 108 to the top and bottom panels 120, 102.

Figure 2:
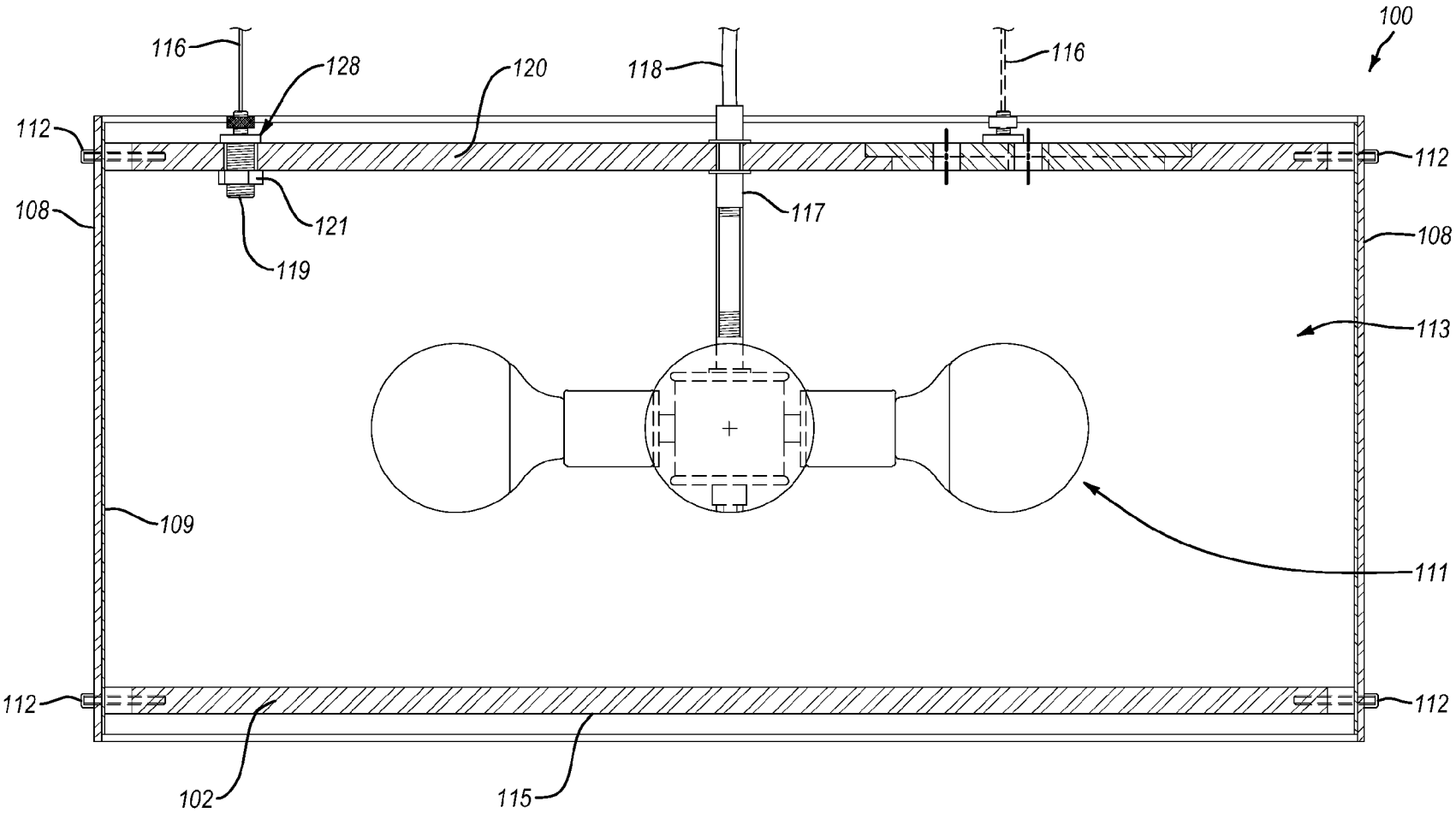
FIG. 2 illustrates a cross-sectional view of the lighting fixture assembly of FIG. 1, taken along the line 2-2 of FIG. 1.

FIG. 2 illustrates a side cross-sectional view of the lighting fixture assembly 100 of FIG. 1, taken along the section line 2-2. As shown by FIG. 2, the bottom panel 102, side panels 108, and a top panel 120 can define an interior space 113, which can house a light source 111. It is noted that due to the configuration of the bottom panel 102 and side panels 108 as described above, the mounting mechanism 114 does not need to extend through the interior space 113 of the lighting fixture assembly 100 and attach to bottom panel 102 or side panels 108. Specifically, as shown by FIG. 2, no supporting hardware may extend from the top panel 120 through the interior space 113 to the bottom panel 102. Indeed, the top panel 120 can support the side panels 108, while the side panels 108 support the bottom panel 102. Thus, in lighting fixture assembly 100, only the top panel 120 is directly secured to mounting mechanism 114. The other components of the lighting fixture assembly 100, including the side panels 108 and the bottom panel 102 are indirectly supported by the mounting mechanism 114.

As can be seen, with the absence of supporting hardware within the interior space 113 of the lighting fixture assembly 100, the appearance of shadows on the exterior surface of the lighting fixture assembly 100 are reduce or eliminated. In particular, because there no frame or rods are between the light source 111 and the side panels 108 and the bottom panel 102, there are no shadows created on the side panels 108 and the bottom panel 102. Similarly, no supporting hardware within the interior space 113 of the lighting fixture assembly 100 will be visible through any gaps between the panels (102, 108, 120).

In addition to the foregoing, the bottom surface 115 of the bottom panel 102 can be devoid of hardware in one or more implementations. For example, FIG. 2 illustrates that no hardware extends through the bottom panel 102 or otherwise covers or obscures the bottom surface 115 of the bottom panel 102. One will appreciate that when the lighting fixture assembly 100 is hung from a ceiling or other overhead support, the bottom surface 115 of the bottom panel 102 can be readily visible. Thus, removing or minimizing hardware or shadows on the bottom surface 115 can greatly improve the aesthetic of the lighting fixture assembly 100.

In one or more implementations, the bottom panel 102, side panels 108, and the top panel 120 can each comprise a resin sheet or panel. As an initial matter, the terms "resin," or "resin-based," as used herein, refer to panels, strips or sheets, comprising a substrate of one or more layers or sheets formed from thermoplastic polymers (or alloys thereof). Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), or the like.

The resin panels (e.g., 102, 108, 120) of the lighting fixture assembly 100 can comprise one or more combinations or alloys of the above-listed thermoplastic materials. As a preliminary matter, implementations of the present invention are described herein primarily with reference to resin panels. One will appreciate, however, that the panels of the lighting fixture assemblies of one or more implementations can include materials other than resin. For example, one or more panels of a given lighting fixture can include wood, stone, fiberglass, fabric, or the like.

Furthermore, the resin panels (e.g., 102, 108, 120) can comprise one or more layers of resin or other materials. For example, in one or more implementations, the resin panels (e.g., 102, 108, 120) can include a decorative inter-layer or outer layer. The decorative layer can provide the lighting fixture assembly 100 with desirable aesthetic qualities. In addition to, or in place of, a decorative image layer, the resin panels (e.g., 102, 108, 120) can be transparent, translucent, or opaque, depending upon the desired aesthetic. Furthermore, the resin panels (e.g., 102, 108, 120) can include color, or can have a clear configuration.

One will appreciate in light of the disclosure herein that one or more implementations of the present invention can provide aesthetically pleasing resin-based lighting fixture assemblies. For instance, the resin-based lighting fixture assemblies can help magnify the aesthetic features of the resin materials used to form the lighting fixtures. Indeed, one or more implementations may help magnify the form, texture, color(s), transparency, and other features of the resin materials. In addition, as previously mentioned, one or more implementations can reduce or eliminate visibility of hardware that could otherwise detract from the aesthetics provided by the resin materials.

Additionally, the side panels, top panels, and/or bottom panels can comprise one or more layers of resin or other materials. For example, in one or more implementations, the side panels, top panels, and/or bottom panels can include a decorative inter-layer. The decorative inter-layer can provide the lighting fixture assembly with desirable aesthetic qualities. In addition to, or in place of, a decorative image layer, side panels, top panels, and/or bottom panels can be transparent, translucent, or opaque, depending upon the desired aesthetic. Furthermore, side panels, top panels, and/or bottom panels can include color, or can have a clear configuration. In one particular implementation, the side panels include a decorative inter-layer while the bottom and/or top panels include translucent resin sheets without a decorative inter-layer.

As previously mentioned, the side panels, top panels, and/or bottom panels can comprise any number of resin layers or decorative layers. For example, the side panels, top panels, and/or bottom panels can include outer resin layers and an inner decorative layer. The decorative inner layer can comprise fabric, metallic wire, rod and/or bar, papers, or photographic images. In yet additional implementations, the decorative inner layer can comprise any organic, inorganic, naturally occurring, or synthetic materials such as rocks, crushed glass, minerals, leaves, twigs, branches, grasses, bamboo shoots, willow, thatch reed, solidified resins, metallic objects, vegetation, and so forth.

The resin panels (e.g., 102, 108, 120) can have a gauge from as thin as about one-eighth inch (⅛") or one quarter inch (¼"), or thinner, to as thick as about one and one-half inches (1½") to about two inches (2"), or thicker, depending on the end-user's designs. In general, thicker gauges tend to be sturdier and more expensive than thinner gauges. In accordance with one or more implementations, the resin panels (e.g., 102, 108, 120) can have thinner gauges, such as anywhere from about one-sixteenth inch (1/16") to about three-eighths inch (⅜").

In one or more implementations, the bottom and top panels 102, 120 can have a greater thickness than the side panels 108. For example, FIG. 2 illustrates that bottom and top panels 102, 120 are twice as thick as the side panels 108. Thus, in one or more implementations the side panels 108 can have a thickness of approximately one-fourth an inch (¼"), while the bottom and top panels 102, 120 each have a thickness of approximately one-half an inch (½"). One will appreciate in light of the disclosure herein that thicker top and bottom panels 120, 102 can help diffuse light within the interior space 113 and help illuminate the side panels 108.

In alternative implementations, the bottom and top panels 102, 120 can be 1.25, 1.50, 1.75, 2.5, or three times as thick as the side panels 108. In further implementations, the bottom and top panels 102, 120 and the side panels 108 can have an equal thickness. In still further implementation, the thickness of the side panels 108 can be greater than the thickness of the bottom and top panels 102, 120.

In any event, in one or more implementations, the top panel 120, bottom panel 102, and or side panels 108 can act as diffusors. Thus, the top panel 120 is sometimes referred herein as a top diffusor. Similarly, the bottom panel 102 is sometimes referred herein to as a bottom diffusor. The side panels 108 on the other hand are sometimes referred hereinto as shade portions. When diffusors, the top and bottom panels 120, 102 can allow the light generated by the light source 111 to spread or diffuse across a surface or an area, instead of appearing to the viewer concentrated at one or more locations. Such diffusion can create a desirable aesthetic appeal for the lighting fixture assembly 100, as well as for the area lighted and/or decorated by the lighting fixture assembly 100.

To help one or more of the panels (e.g., 102, 120, 108) to act as diffusors, the inner and/or outer surfaces of the panels (e.g., 102, 120, 108) can include surface texture or roughness. In particular, a manufacturer can apply a surface texture or roughness to the one or more of the panels (e.g., 102, 120, 108) by sanding the resin panels with sandpaper to create a matte or dull surface. Additionally or alternatively, the manufacturer can form single- or multi-faceted depressions and/or protrusions on one or more surfaces of the panels (e.g., 102, 120, 108) to increase their diffusive properties.

In still further implementations, the one or more of the panels (e.g., 102, 120, 108) can comprise a translucent suede material or have a translucent suede outer or inner layer. For example, FIG. 2 illustrates that the side panels 108 include a translucent suede layer 109 laminated to an inner surface thereof. Similar to the texture, the translucent suede material can spread or diffuse across a surface or an area. Thus, the translucent suede layer 109 can help reduce hot spots or the visibility of the light source 111 through the side panels 108.

FIG. 2 further illustrates that the top panel 120 can support the light source 111. In particular, a rod 117, wire or other hardware can extend from the top panel 120 and hold one or more light sources 111 in the interior space 113 of the lighting fixture assembly 100. In one or more implementations, the rod 117 is hollow to allow electrical wiring 118 to reach and power the light source 111. The light source 111 can comprise a light bulb as shown in FIG. 2. In particular, the light source can comprise incandescent lights, fluorescent lights, or light-emitting-diodes ("LEDs"). In any event, the light source 111 can illuminate the resin panels (e.g., 102, 108, 120) and provide a desirable aesthetic affect in addition to acting as a source of light.

As mentioned previously, the mounting mechanism 114 can attach to and support the top panel 120. For example, FIG. 2 shows that the mounting mechanism 114 can comprise one or more cables 116. The cables 116 attach to an overhead support, such as a ceiling, at one end. An opposing end of the cables 116 can attach to a mounting bracket 128 that attaches to the top panel 120. For example, FIG. 2 illustrates that the mounting bracket 128 can comprise a threaded rod 119 extending through the top panel 120 and a bolt 121 attached to the threaded rod 119. The inner surface of the top panel 120 can rest upon the bolts 121 to suspend the lighting fixture assembly 100 from a support surface.

As previously mentioned, implementations of the present invention can reduce shadows at the joints of external panels (i.e., side panels 108, top panel 120, or bottom panel 102). Specifically, the lighting fixture assembly 100 can include a gap that separates, in whole or in part, edges of adjacent panels. This gap or separation between adjacent panels may reduce shadows created by abutting panels.

Figure 3:
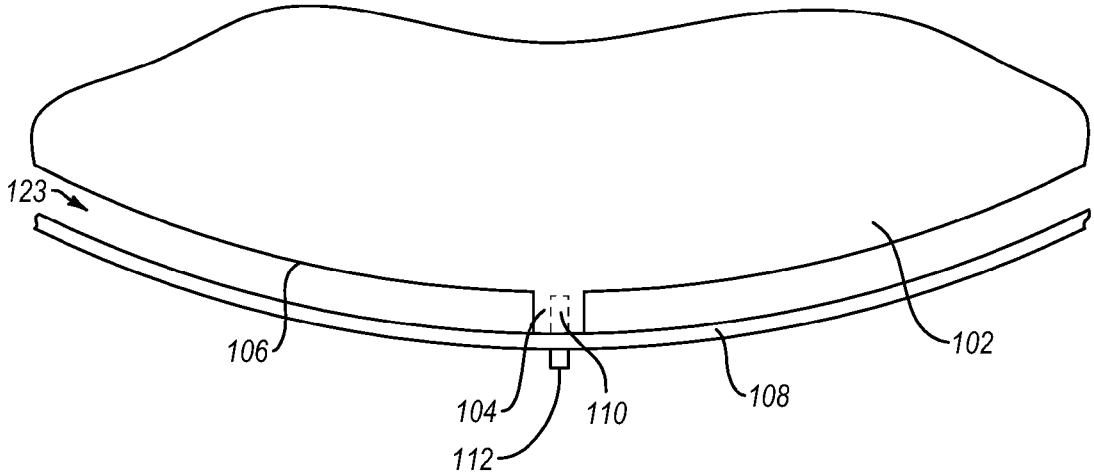
FIG. 3 illustrates a close-up view of the attachment between the bottom panel and a side panel of the lighting fixture assembly of FIG. 1.

For example, FIG. 3 illustrates a close-up view of a connection between one of the side panels 108 and the bottom panel 102. In particular, the bottom panel 102 includes a plurality of protrusions 104 that extend outwardly away from an outer edge 106 of bottom panel 102. The protrusions 104 can include receptacles 110 (shown in dashed lines) for receiving a fastening assembly 112 that connects the side panels 108 to bottom panel 102. Side panels 108 may include apertures that align with receptacles 110.

The fastening assemblies 112 can comprise any suitable mechanism for securing the side panels 108 to the bottom panel 120. For example, fastening assemblies 112 can comprise a threaded rod that screws into the receptacle 110. The fastening assembly 112 can further include a cap that attaches to an end of the threaded rod. As shown by FIG. 3, the cap of the fastening assembly 112 can hold the side panel 108 against the protrusion 104. One will appreciate that in such implementations, the receptacle 110 can comprise a threaded bore.

One will recognize in light of the disclosure herein that many other suitable fastening mechanisms can replace the threaded rod and threaded receptacle configuration depicted in FIG. 3. For example, in alternative implementations, the protrusions 104 can include a recess for receiving a non-threaded fastener. Alternatively still, protrusions 104 may not include receptacles 110 for receiving a fastener. In such implementations, the protrusions 104 may couple directly to the side panels via an interference or snap-fit engagement.

Thus, in addition or alternative to a treaded rod, the fastening assemblies 112 can comprise adhesives, VELCRO, rivets, clips, and other fasteners. Additionally, it is feasible to connect the side panels to the bottom panel without the use of a separate connector such as by using a bonding agent or an interlocking design. For example, the one or more side panels 108 may include openings or other slots for receiving protrusions 104 of a particular shape and/or size. In such implementations, the protrusions 104 may be of sufficient length and shape to still provide a gap, described in more detail hereafter, between side panels 108 and a bottom panel 102.

In still further implementations, the fastening assemblies 112 may comprise a melt-bondable mounting bracket that secures directly into the resin material of the interior surface of a side panel 108. For example, the fastening assemblies 112 can comprise melt-bondable mounting brackets such as those disclosed in U.S. patent application Ser. No. 13/129,239, entitled PANEL MOUNTING COMPONENTS, SYSTEMS, AND METHODS, the entire contents of which are hereby incorporated by reference. One will appreciate that the melt-bondable mounting brackets can securely mount a side panel 108 to a bottom 102 (or top 120) panel without covering or otherwise obscuring any portion of the outer surfaces of the side panels 108.

In any event, as shown by FIG. 3, the protrusions 104 can create a gap 123 between all or portions of the outer edges 106 of the bottom panel 102 and side panels 108. The size of the gap 123 between portions of an outer edge 106 of the bottom panel and the side panel 108 depends on the length of the protrusion(s). A larger protrusion 104 can create a larger gap 126.

For example, the length of the protrusions 104 can correspond with the size of the lighting fixture assembly 100. Specifically, the preferred width of the gap 123 between the side panels 108 and a bottom and/or top panel may be based on the position of the light within the internal space of the lighting fixture assembly 100. Alternatively, the preferred width of a gap 123 between the side panel 108 and the bottom and/or top panel may be based on the angle at which the light hits the surface of the top panel and/or bottom panel. In one or more implementations, the length of protrusions 104 is between ½ inch and 5 inches. For example, in one or more implementations the length of the protrusions 104 is approximately 1 inch, 1.5 inches, 2 inches, 2.5 inches, 3 inches, 3.5 inches, 4 inches, or 4.5 inches. In alternative implementations, the length of protrusions 104 is less than ½ inch or greater than 5 inches.

Along related lines, the gap 123 between top and bottom panels 122 and 102 and the side panels 108 may be between ½ inch and 5 inches. For example, in one or more implementations, the gap 123 is approximately 1 inch, 1.5 inches, 2 inches, 2.5 inches, 3 inches, 3.5 inches, 4 inches, or 4.5 inches. In alternative implementations, the gap 123 is less than ½ inch or greater than 5 inches. In any event, the gap 123 can have a size that reduces shadows and adds to the aesthetics of the lighting fixture assembly 100.

As shown by FIG. 3, in one or more implementations, the protrusions 104 are integrally formed with bottom panel 102. For example, in one or more implementations a manufacturer can form bottom panel 102 using a computer numerical control machine (CNC machine) that cuts the shape of bottom panel 102 and protrusions 104 from a sheet of material. In one or more additional implementations, the manufacturer can hand cut the shape of bottom panel 102 and protrusions 104 from a sheet of material, or injection mold bottom panel 102 with integrated protrusions 104.

In alternative implementations, the protrusions 104 can comprise separate and distinct elements. For example, the protrusions 104 can comprise separate hardware components that are added to the outer edge 106 of the bottom panel 102. Specifically, the protrusions 104 can comprise one or more standoff barrels. In such implementations, the manufacturer can insert a fastener through the side panel 108 and the standoff barrel, and then into the bottom panel 102. Such non-integral protrusions can comprise a polymer, or a metal or alloy thereof, such as for example, aluminum. One will appreciate, however, that these and other components described herein can be prepared from any number of synthetic or naturally occurring resins, rubbers, glass, ceramics, and/or composites thereof.

In alternative implementations, the bottom panel 102 can lack protrusions (i.e., the outer edge of the bottom panel could be a single continuous edge). As stated above, however, by providing the gap 123 between the bottom panel 102 and the side panels 108 can provide further aesthetic benefits by reducing or eliminating the shadows caused when a bottom panel adjoins a side panel.

Figure 4:
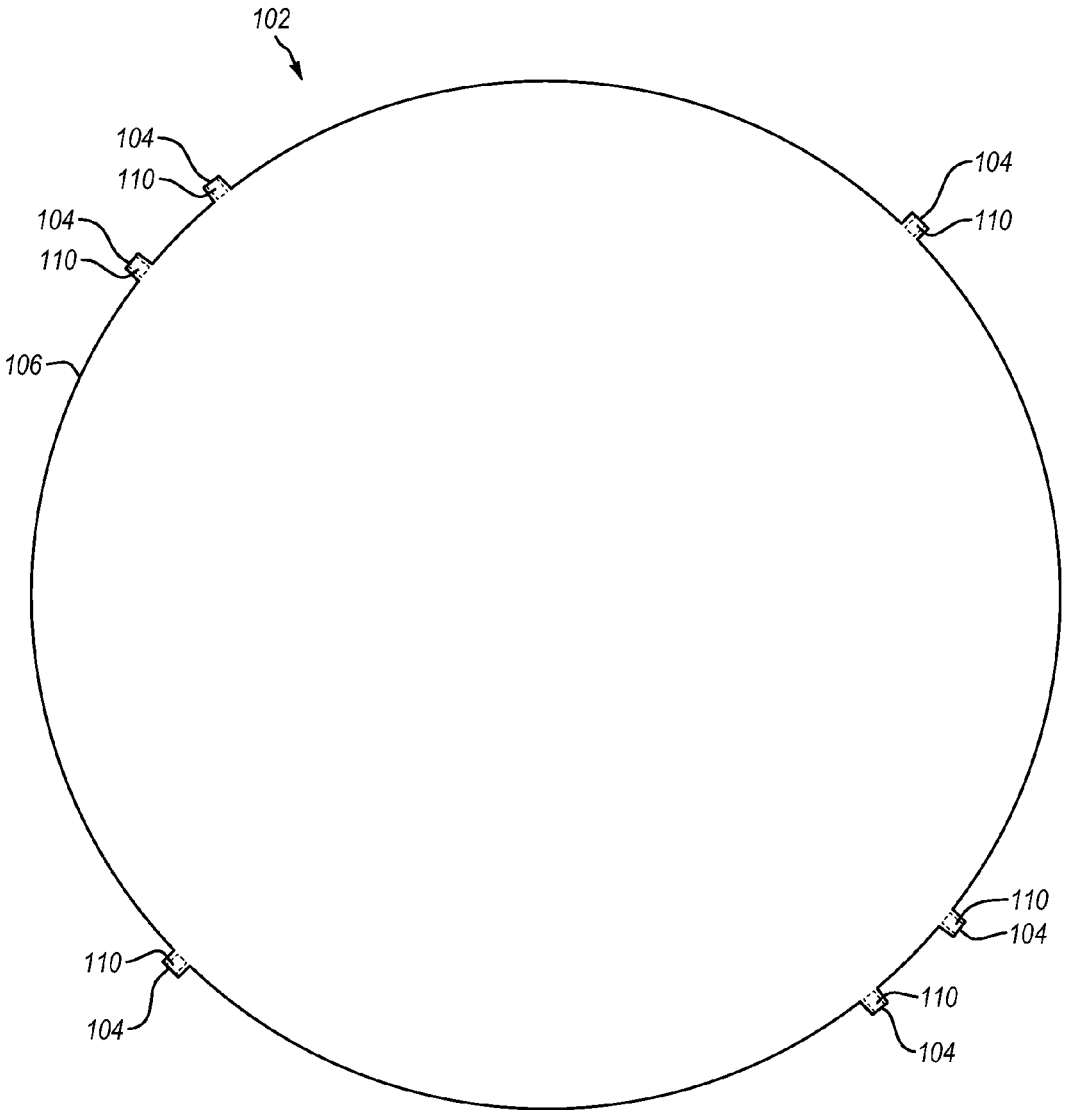
FIG. 4 illustrates a bottom plan view of the bottom panel of the lighting fixture assembly of FIG. 1.

Referring now to FIG. 3, a bottom plan view of the bottom panel 102 is shown. As shown, in one or more implementations the bottom panel 102 includes a plurality of protrusions 104 that extend outwardly away from an outer edge 106 of bottom panel 102. The bottom panel 106 may include any number of protrusions 104. For example, FIG. 3 illustrate that the bottom panel 102 includes six separate protrusions 104 that extend away from outer edge 106. Accordingly, the protrusions 104 can attach to each of side panels 108 in three separate places. Specifically, the protrusions 104 can attach to both ends of the side panels 108 and in approximately the middles of the side panels 108. Although FIG. 4 illustrates that the bottom panel 102 includes six protrusions 104, in alternative implementations the bottom panel 102 can include any number of protrusions. The number of protrusions can vary based on various factors such as the number of side panels 108, the size and weight of the bottom panel 102 and/or side panels 108, or aesthetic factors such as a desired number of fasteners.

One will appreciate in light of the disclosure herein that because the bottom panel 102 attaches to side panels 108 along its outer edge 106, the top and bottom surfaces of the bottom panel 102 lack mounting hardware. Thus, protrusions 104 can allow for the reduction or elimination of hardware on the top and bottom surfaces of the bottom panel 102. The reduction or elimination of mounting hardware on the top and bottom surfaces of bottom panel 102 or hardware extending above bottom panel 102 can greatly add to the aesthetic appeal of the lighting fixture assembly 100.

Lighting fixture assembly 100 also includes a top panel 120 and a mounting mechanism 114. These mechanisms are more clearly illustrated in FIG. 4. As can be seen in FIG. 4, the top panel 120 can have a similar shape and configuration to the bottom panel 102. For example, FIG. 4 illustrates that the top panel 120 has a circular shape that is similar to the bottom panel 102. In alternative embodiments, however, the shape of the top panel 120 can differ from the shape of the bottom panel 102. For example, one of the top panel 120 and the bottom panel 102 can be smaller than the other of the top panel 120 and the bottom panel 102. This can cause the lighting fixture assembly to increase or decrease in diameter along its longitudinal axis.

In one or more implementations, the top panel 120 attaches to side panels 108 in the same manner as the bottom panel 102, as more fully described above. In a particular, as shown by FIG. 4, the top panel 120 includes an outer edge 124 that includes a plurality of protrusions 104 that extend outwardly away from an outer edge 124. As with the bottom panel 102, the top panel 120 may include any number of protrusions 104. In addition, the protrusions 104 can vary in length, width, and shape. The illustrated implementation shows the top panel 120 includes six separate protrusions 104. Furthermore, fastening assemblies 112 can attach the side panels 108 to the protrusions 104 of the top panel 120 in a manner similar to that described herein above in relation to the bottom panel 102.

Figure 5:
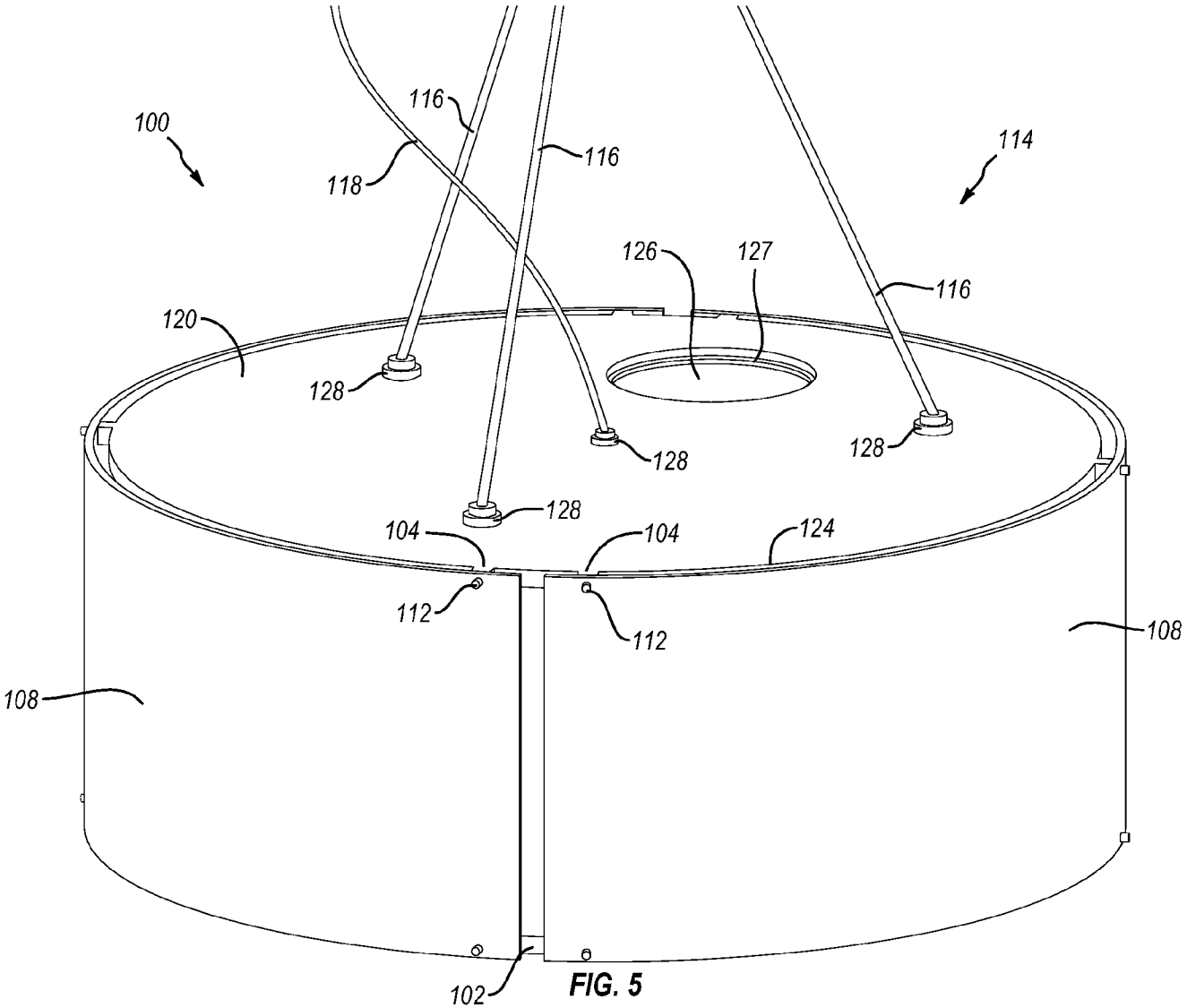
FIG. 5 illustrates a top perspective view of the lighting fixture assembly of FIG. 1.
Figure 6:
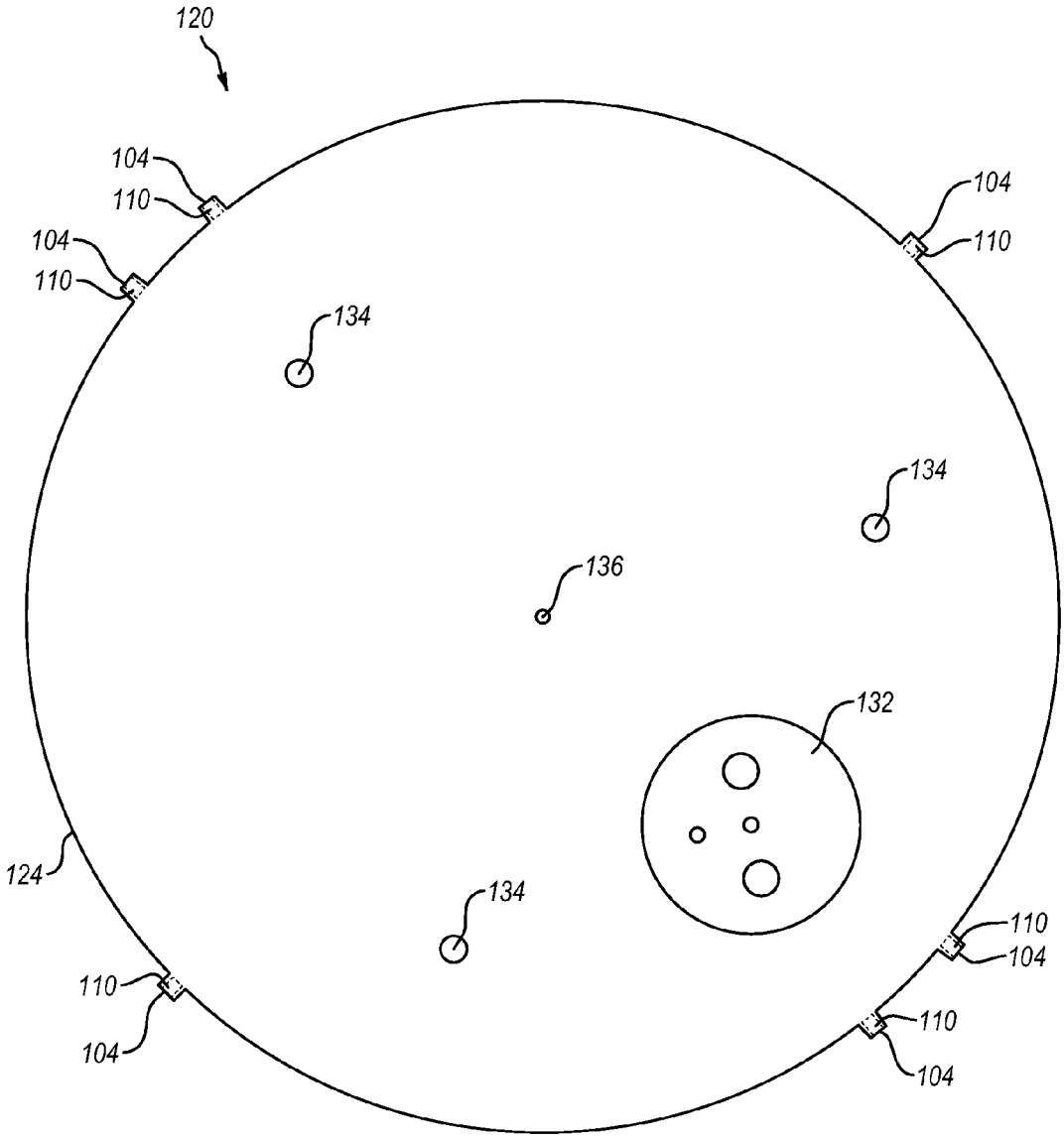
FIG. 6 illustrates a top plan view of the top panel of the lighting fixture assembly of FIG. 1.

FIG. 5 further illustrates the mounting mechanism 114 (i.e., the cables 116 and mounting brackets 128) that secures the lighting fixture assembly 100 to a support structure. Additionally, FIG. 5 illustrates that the top panel 120 can include an access opening 126. The access opening 126 provides an access point through which a light bulb and/or other electrical components may be accessed, for example, to change a light bulb. In one or more implementations, access opening 126 includes a removable cover 132 (FIG. 6). In particular, the access opening 126 can include a lip 127 upon which the removable cover 132 rests. Referring now to FIG. 6, the removable cover 132 may serve to maintain the functionality of top panel 120 (i.e., the reflection of light towards the side and/or bottom panels) when in place. Furthermore, the removable cover 132 can include one or more holes that allow a user to grip or otherwise remove the cover 132.

As can also be seen in FIG. 6, top panel 120 can further include a variety of openings mounting openings 134, 136, through which the supporting hardware, lighting fixtures, and electrical components may attach to the lighting fixture assembly 100. For example, mounting brackets 128 (shown in FIG. 2) may attach to the top panel 120 through mounting openings 134 in accordance with one or more implementations of the present invention. Cables 116 may attach to the mounting brackets 128 to suspend lighting fixture assembly 100 from an overhead structure, such as a ceiling.

In one or more implementations of the present invention, the lighting fixture assembly 100 may not include a top panel 120. In such implementations, a mounting mechanism 114 may attach directly to one or more side panels 108. For example, supporting wires, brackets, or other supporting means may attach directly to the one or more side panels 108 in a plurality of locations in any suitable manner.

Mounting opening 136 allows the electrical wiring 118 to enter the lighting fixture assembly to connect to a light source 111 (FIG. 2). Electrical wiring 118 may include hardware to secure the electrical wiring to the top panel 120 to maintain the position of the light source 111 within the lighting fixture assembly 100. For example, a bracket 130 may be used to maintain the position of the light source 111 within the lighting fixture assembly 100.

Although lighting fixture assembly 100 comprises a round drum-type lighting fixture, one of skill in the art will understand that lighting fixture assemblies of the present invention may include virtually any shape including conventional shapes such as squares, rectangles, and triangles as well as random shapes including those with many arcs, angles, or sides. In other words, the present invention is not limited to lighting fixture assemblies of any particular shape or size.

Figure 7:
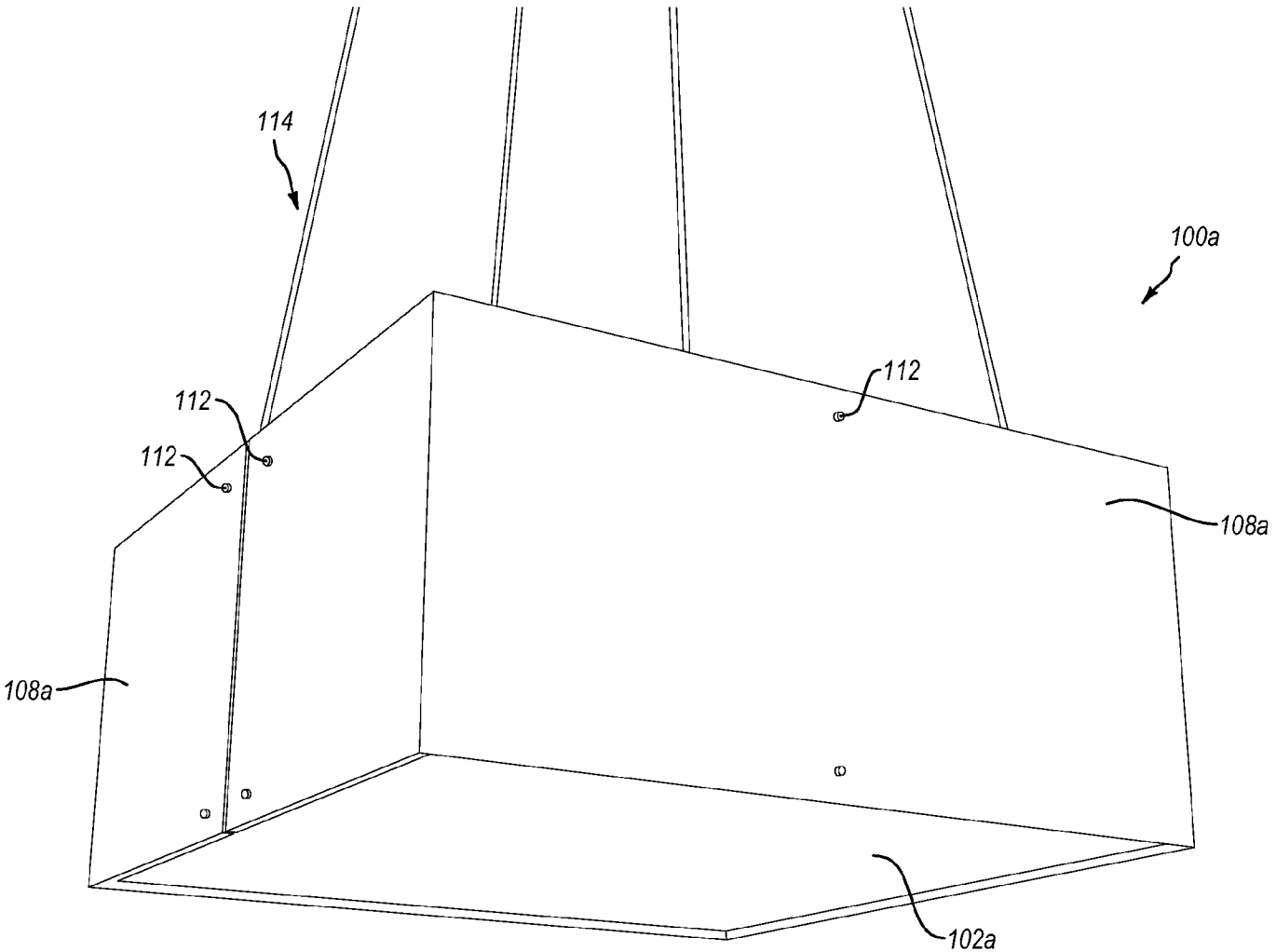
FIG. 7 illustrates a bottom perspective view of rectangular lighting fixture assembly in accordance with one or more implementations of the present invention.

For example, FIG. 7 illustrates a bottom perspective view of another lighting fixture assembly 100*a*. The lighting fixture assembly 100*a* is similar to the lighting fixture assembly 100, albeit that the lighting fixture assembly 100*a* has a rectangular shape.

Specifically, the lighting fixture assembly 100*a* can include a mounting mechanism 114 that supports a top panel. The top panel in turn can support a side panel 108*a*. FIG. 7 further illustrates that the side panels 108*a* can wrap around one or more corners of the lighting fixture assembly 100*a*. The side panels 108*a* in turn can support the bottom panel 102*a*, such that no supporting hardware extends through the interior of the lighting fixture assembly 100*a* or covers the bottom surface of the bottom panel 102*a*. Furthermore, protrusions can space the top and bottom panels from the side panels 108*a*. The protrusions can create a gap that reduces shadows between the top and bottom panels and the side panels 108*a*.

Figure 8:
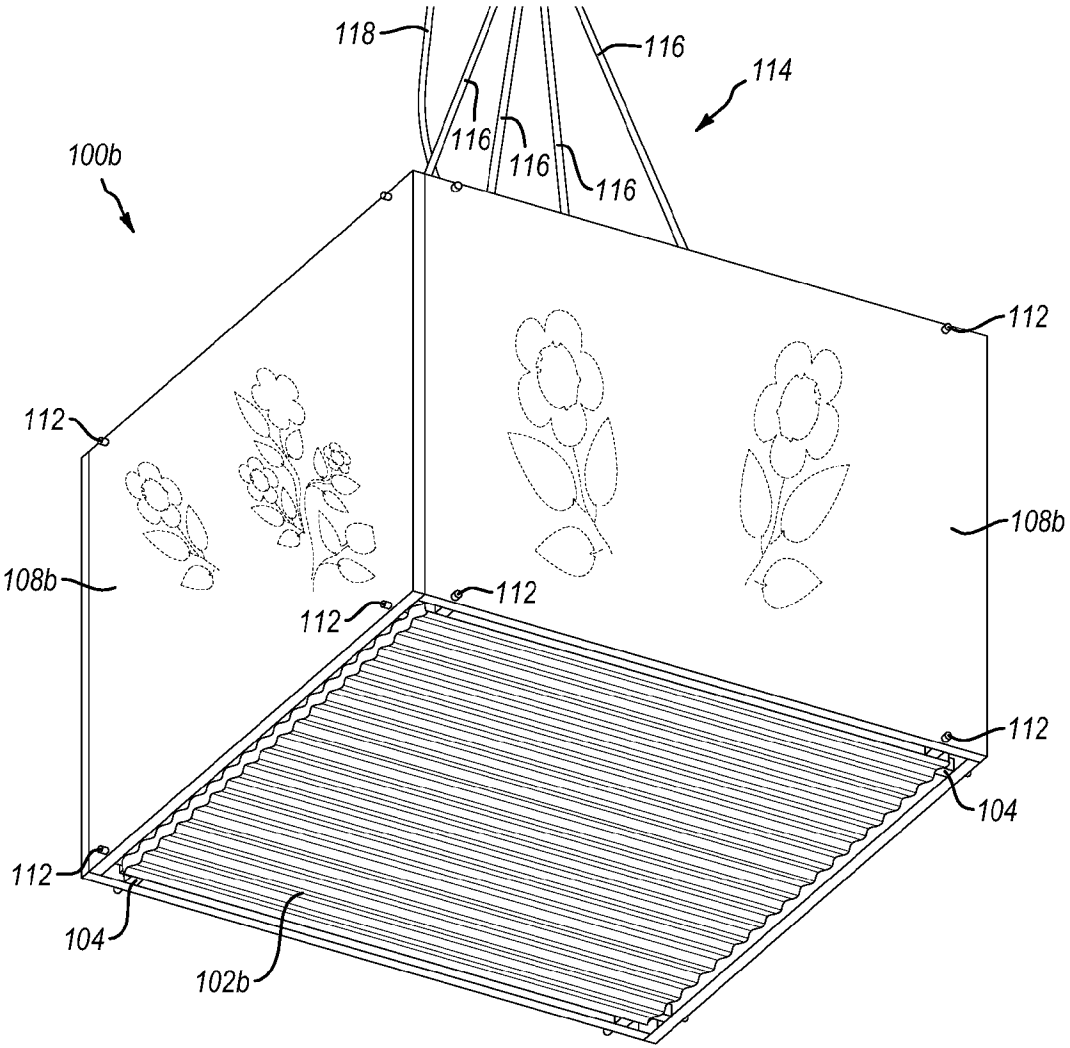
FIG. 8 a bottom perspective view of another lighting fixture assembly in accordance with one or more implementations of the present invention.
Figure 9:
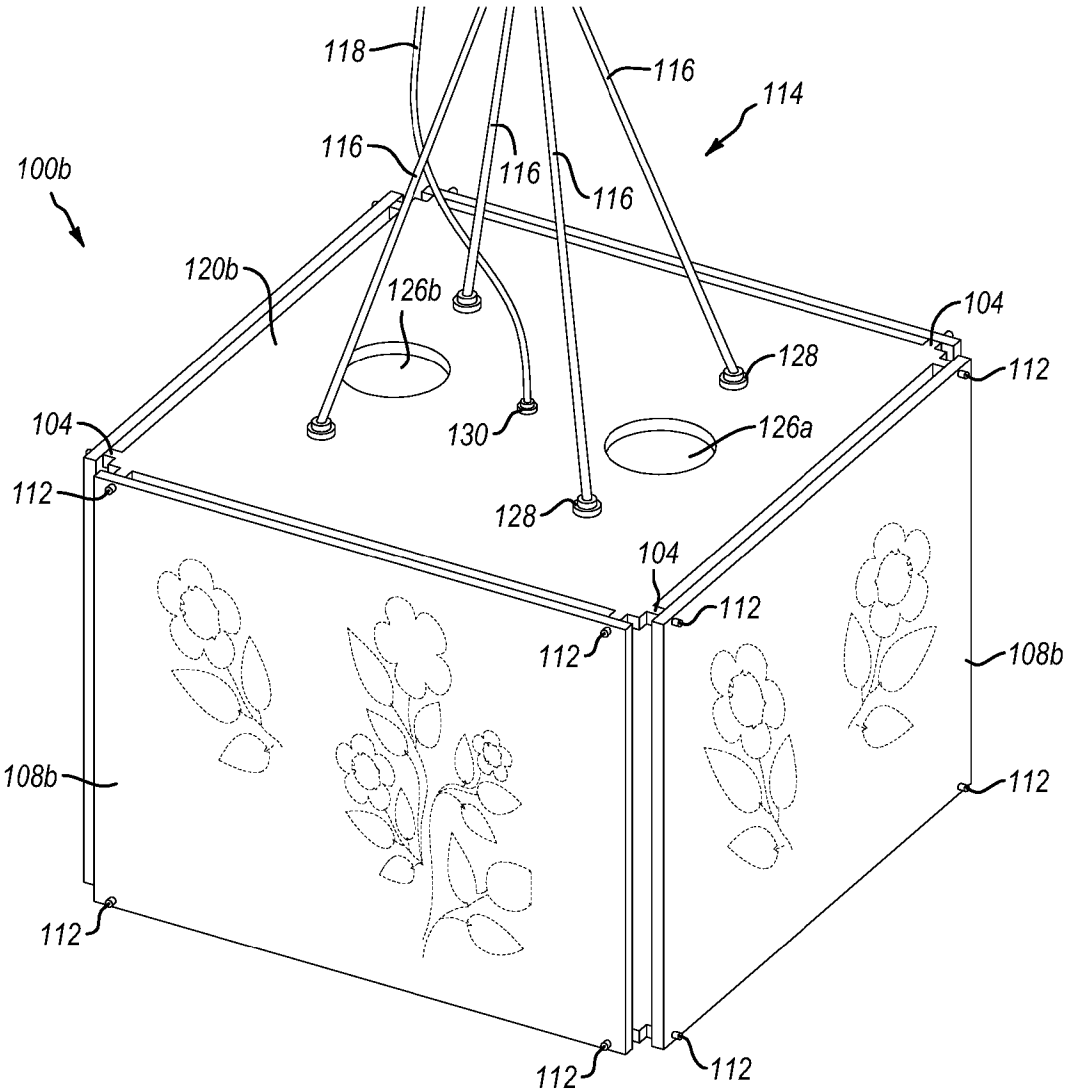
FIG. 9 illustrates a top perspective view of the of the lighting fixture assembly of FIG. 8.

FIGS. 8 and 9 illustrate another implementation of the present invention. Specifically, FIGS. 8 and 9 illustrate lighting fixture assembly 100*b*. FIG. 8 illustrates a bottom perspective view of lighting fixture assembly 100*b*. As can be seen in FIG. 8, lighting fixture assembly 100*b* includes a bottom panel 102*b* that is quadrilateral, having four sides. The bottom panel 102*b* is also non-planar. Specifically, the bottom panel 102*b* includes a series of parallel ridges that run along the length of bottom panel 102*b*.

Lighting fixture assembly 200 also includes four side panels 108*b*. Side panels 108*b* are also quadrilateral and flat. In addition, side panels 108*b* include etched flower patterns. Protrusions 104 secure the bottom panel 102*b* to the side panels 108*b* via fastening assemblies 112, similar to as described herein above in relation to lighting fixture assembly 100. Specifically, the side panels 108*b* support the bottom panel 102*b*, such that no supporting hardware extends through the interior of the lighting fixture assembly 100*b* or covers the bottom surface of the bottom panel 102*b*. Furthermore, protrusions 104 can space the top and bottom panels from the side panels 108*b*. The protrusions can create a gap that reduces shadows between the top and bottom panels and the side panels 108*b*.

FIG. 9 illustrates a top perspective view of lighting fixture assembly 100*b*. As can be seen in FIG. 9, the lighting fixture assembly 100*b* also includes a top panel 120*b* and a mounting mechanism 114. Top panel 120*b* is also quadrilateral. Protrusions 104 secure top panel 120*b* to side panels 108*b* via fastening assembles 112, as previously described. The mounting mechanism 114, which includes four mounting brackets 128 are secured within holes in top panel 120*b*. The mounting mechanism can also include four cables 116, which may be used to secure lighting fixture assembly 100*b* to an overhead structure such as a ceiling. The pop panel 102*b* also includes two openings 126*a* and 126*b* through which a light fixture may be accessed, for example, to change a light bulb.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A lighting fixture assembly that lacks internal mounting hardware extending there through, the lighting fixture assembly comprising:

a top panel having an outer edge;

one or more side panels, the one or more side panels being secured to the outer edge of the top panel;

a bottom panel having an outer edge, the outer edge of the bottom panel being secured to the one or more side panels such that the bottom panel is supported by the one or more side panels; and a mounting mechanism configured to secure the lighting fixture assembly to a support surface;

wherein:

the bottom panel is indirectly secured to the mounting mechanism via the one or more side panels;

no hardware extends from the top panel to the bottom panel; and the outer edge of the top panel is configured with a plurality of protrusions to which the one or more side panels attach to thereby create a gap between portions of the outer edge of the top panel and the one or more side panels.

2. The lighting fixture assembly of claim 1, wherein the outer edge of the bottom panel is configured with a plurality of protrusions to which the one or more side panels attach to thereby create a gap between portions of the outer edge of the bottom panel and the one or more side panels.

3. The lighting fixture assembly of claim 2, further comprising a plurality of fastening mechanisms securing each protrusion to the one or more side panels.

4. The lighting fixture assembly of claim 3, wherein the fasteners comprises threaded rods secured within threaded receptacles in the protrusions.

5. The lighting fixture assembly of claim 1, wherein a bottom surface of the bottom panel is devoid of hardware.

6. The lighting fixture assembly of claim 1, wherein one or more of the top panel and the bottom panels are configured as diffusors.

7. The lighting fixture assembly of claim 6, wherein one or more of the top panel and the bottom panels comprise a translucent suede material.

8. The lighting fixture assembly of claim 1, wherein the top panel includes at least one access opening configure to provide access to an interior space defined by the top panel, one or more side panels, and the bottom panel.

9. The lighting fixture assembly of claim 1, wherein the one or more side panels comprise a resin sheets.

10. A lighting fixture assembly with reduced shadowing, comprising:

one or more side panels;

a bottom panel having an outer edge comprising a plurality of protrusions;

a plurality of fastening mechanisms securing the plurality of protrusions of the bottom panel to the one or more side panels;

wherein the plurality of protrusions create a gap between portions of the outer edge of the bottom panel and the one or more side panels, the gap reducing shadows between the one or more side panels and the bottom panel.

11. The drum lighting fixture assembly of claim 10, further comprising:

a top panel having an outer edge comprising a plurality of protrusions; and a second plurality of protrusions of the top panel to the one or more side panels;

wherein the second plurality of protrusions create a second gap between portions of the outer edge of the top panel and the one or more side panels, the second gap reducing shadows between the one or more side panels and the top panel.

12. The drum lighting fixture assembly of claim 11, further comprising a mounting mechanism that attaches directly to only the top panel such that the one or more side panels and the bottom panel are supported indirectly via the top panel.

13. The lighting fixture assembly of claim 12, wherein the protrusions on the outer edges of the top and bottom panels include receptacles for receiving a fastener for attaching the one or more side panels to the top and bottom panels.

14. The lighting fixture assembly of claim 12, wherein no hardware extends from the top panel to the bottom panel.

15. The lighting fixture assembly of claim 12, wherein the bottom panel comprises a resin-based panel and the plurality of protrusions are integrally formed with the bottom panel.

16. The lighting fixture assembly of claim 12, wherein the bottom and top panels are circular and the one or more side panels comprise two curved translucent panels.

17. A lighting fixture assembly, comprising:

a translucent top panel having an outer edge and at least one opening to provide access to an interior of the lighting fixture assembly;

a translucent bottom panel having an outer edge comprising a plurality of protrusions;

one or more translucent side panels having an upper portion and a lower portion;

wherein:

the outer edge of the top panel is secured to the upper portion of the one or more side panels;

the plurality of protrusions along the outer edge of the bottom panel are secured to the lower portion of the one or more side panels thereby creating a gap between portions of the outer edge of the bottom panel and the one or more side panels; and a mounting mechanism directly secured to the top panel;

wherein the one or more side panels and the bottom panel are indirectly supported by the mounting mechanism via the top panel.

18. The lighting fixture assembly as recited in claim 17, wherein the one or more side panels include a diffusor layer secured to an inner surface thereof.

19. The lighting fixture assembly as recited in claim 18, wherein the diffusor layer comprises a translucent suede material.

20. A lighting fixture assembly that lacks internal mounting hardware extending there through, the lighting fixture assembly comprising:

a top panel having an outer edge;

one or more side panels, the one or more side panels being secured to the outer edge of the top panel;

a bottom panel having an outer edge, the outer edge of the bottom panel being secured to the one or more side panels such that the bottom panel is supported by the one or more side panels; and a mounting mechanism configured to secure the lighting fixture assembly to a support surface;

wherein:

the bottom panel is indirectly secured to the mounting mechanism via the one or more side panels;

no hardware extends from the top panel to the bottom panel; and the outer edge of the bottom panel is configured with a plurality of protrusions to which the one or more side panels attach to thereby create a gap between portions of the outer edge of the bottom panel and the one or more side panels.

21. The lighting fixture assembly of claim 20, further comprising a plurality of fastening mechanisms securing each protrusion to the one or more side panels.

22. The lighting fixture assembly of claim 21, wherein the fasteners comprises threaded rods secured within threaded receptacles in the protrusions.

23. The lighting fixture assembly of claim 20, wherein a bottom surface of the bottom panel is devoid of hardware.

24. The lighting fixture assembly of claim 20, wherein one or more of the top panel and the bottom panels are configured as diffusors.

25. The lighting fixture assembly of claim 24, wherein one or more of the top panel and the bottom panels comprise a translucent suede material.

26. The lighting fixture assembly of claim 20, wherein the top panel includes at least one access opening configure to provide access to an interior space defined by the top panel, one or more side panels, and the bottom panel.

27. The lighting fixture assembly of claim 20, wherein the one or more side panels comprise a resin sheets.

28. The lighting fixture assembly of claim 27, wherein the outer edge of the top panel is configured with a plurality of protrusions to which the one or more side panels attach to thereby create a gap between portions of the outer edge of the top panel and the one or more side panels.

* * * * *

UNITED STATES PATENT AND TRADEMARK OFFICE

CERTIFICATE OF CORRECTION

PATENT NO. : 9,028,114 B2
APPLICATION NO. : 14/130929
DATED : May 12, 2015
INVENTOR(S) : Smith It is certified that error appears in the above-identified patent and that said Letters Patent is hereby corrected as shown below:

In the Specification

Column 4
Line 48, change "bottom panel 120" to --bottom panel 102--

Column 8
Line 51, change "126" to --123--

Column 9
Line 41, change "FIG. 3" to --FIG. 4--
Line 46, change "FIG. 3" to --FIG. 4--

Column 10
Line 5, change both occurrences of "FIG. 4" to --FIG. 5--
Line 7, change "FIG. 4" to --FIG. 5--
Line 19, change "FIG. 4" to --FIG. 5--

Column 11
Line 38, change "assembly 200" to --assembly 100b--

Signed and Sealed this
First Day of March, 2016

Michelle K. Lee

Michelle K. Lee
*Director of the United States Patent and Trademark Office*